US010342318B2

(12) United States Patent
Winfield

(10) Patent No.: US 10,342,318 B2
(45) Date of Patent: Jul. 9, 2019

(54) BACKPACK WITH ADJUSTABLE SHOULDER STRAPS

(71) Applicants: STARRY LIMITED, Quarry Bay (CN); Menachem Pinhas Winfield, Katzir (IL)

(72) Inventor: Menachem Pinhas Winfield, Katzir (IL)

( * ) Notice: Subject to any disclaimer, the term of this patent is extended or adjusted under 35 U.S.C. 154(b) by 0 days.

(21) Appl. No.: 15/738,958

(22) PCT Filed: Jun. 24, 2016

(86) PCT No.: PCT/IL2016/050675
§ 371 (c)(1),
(2) Date: Dec. 21, 2017

(87) PCT Pub. No.: WO2016/207896
PCT Pub. Date: Dec. 29, 2016

(65) Prior Publication Data

US 2018/0184787 A1 Jul. 5, 2018

Related U.S. Application Data

(60) Provisional application No. 62/184,582, filed on Jun. 25, 2015.

(51) Int. Cl.
*A45F 3/04* (2006.01)

(52) U.S. Cl.
CPC ..... *A45F 3/047* (2013.01)

(58) Field of Classification Search
CPC ..... A45F 3/047; A45F 3/08; A45F 2003/045; A45F 3/04; A45F 3/02; A45F 3/06
See application file for complete search history.

(56) References Cited

U.S. PATENT DOCUMENTS 4,706,993 A 11/1987 Tamura
5,004,135 A * 4/1991 Dufournet ..... A45F 3/047 224/262

(Continued)

FOREIGN PATENT DOCUMENTS

GB 2235617 A 3/1991

*Primary Examiner* — Corey N Skurdal
(74) *Attorney, Agent, or Firm* — Maxwell L. Minch; GrayRobinson, P.A.

(57) ABSTRACT

This invention is directed to a driving screw based adjusting mechanism for adjusting the shoulder straps length of a backpack for fitting the position of the backpack to the torso length of a wearer, said adjusting mechanism comprises: (a) a shell like element configured to be attached to the back wall of the backpack for holding a driving screw and a slider; (b) a driving screw connected to a key, said key is configured to allow rotation of the driving screw clockwise and counter clockwise; and (c) a slider configured to be attached to a shoulder straps belt of the backpack and further to be latched onto the shell like element, with the driving screw threaded within it; wherein, rotation of the driving screw clockwise and counter clockwise functionally slides the slider upward and downward along the shell like component together with the shoulder straps belt of the backpack that are attached to the slider, thereby enabling elongation/shortening of the backpack shoulder straps length. This invention is further directed to a backpack having this shoulder straps adjusting mechanism.

19 Claims, 8 Drawing Sheets

(56) References Cited

U.S. PATENT DOCUMENTS

| | | | | | |
|---|---|---|---|---|---|
| 5,165,719 | A * | 11/1992 | Yano | B60R 22/201 | 280/801.2 |
| 5,358,274 | A * | 10/1994 | Watanabe | B60R 22/201 | 280/801.2 |
| 5,449,102 | A * | 9/1995 | Sason | A45F 3/047 | 224/632 |
| 5,503,314 | A * | 4/1996 | Fiscus | A45F 3/08 | 224/262 |
| 5,806,740 | A * | 9/1998 | Carlson | A45F 3/047 | 224/259 |
| 7,028,873 | B1 * | 4/2006 | Collier | A45F 3/08 | 224/628 |
| 7,232,048 | B2 * | 6/2007 | Le Gal | A45F 3/04 | 224/201 |
| 7,946,460 | B2 * | 5/2011 | Yip | A45F 3/047 | 224/627 |
| 8,544,709 | B2 * | 10/2013 | Paik | A45F 3/04 | 224/632 |
| 8,678,258 | B1 | 3/2014 | Knight et al. | | |
| 9,119,459 | B2 * | 9/2015 | Kim | A45F 3/08 | |
| 9,462,875 | B2 * | 10/2016 | Paduano | A45F 3/047 | |
| 9,591,910 | B2 * | 3/2017 | Kemp | A45F 3/047 | |

* cited by examiner

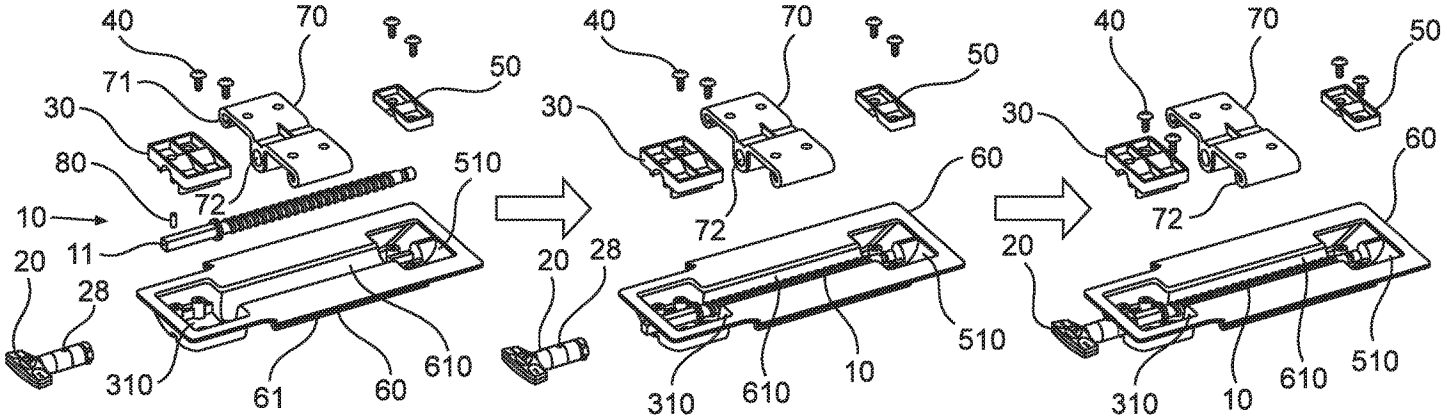
FIGURE 2A
FIGURE 2B
FIGURE 2C
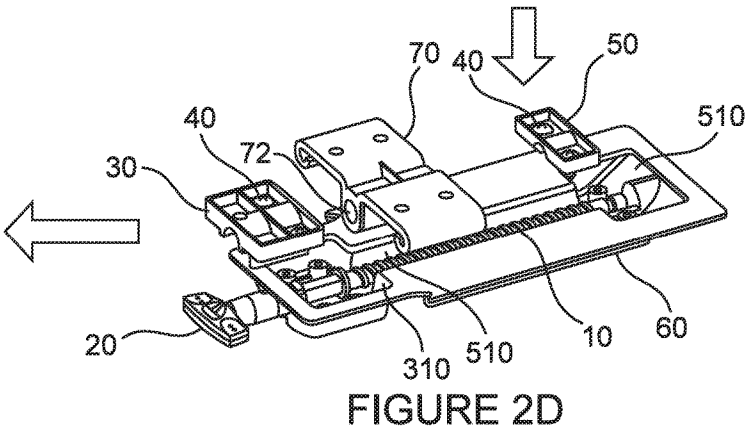
FIGURE 2D
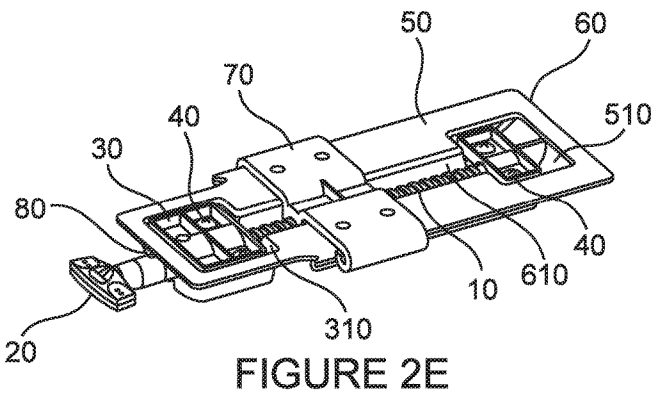
FIGURE 2E

BACKPACK WITH ADJUSTABLE SHOULDER STRAPS

FIELD OF THE INVENTION

The invention is directed to a novel backpack having an adjustment mechanism for adjusting the shoulder straps length of the backpack for fitting it to a wearer's torso length. More particular, the invention is directed to a backpack with a driving screw based mechanism for adjusting the shoulder straps length to a specific wearer dimensions in real time, while the backpack is placed with its content on the wearer's back.

BACKGROUND

A major problem involved with carrying a backpack is that a heavy load in the backpack tends to severely compress the shoulders of the user and cause several adverse effects such as but not limited to restriction in the movement of the neck and the shoulders of the backpack wearer, intense pain in the shoulder muscle, severe restriction in the ability to breath and irreversible damage to the vertebrate. These problems may be minimizes if the backpack is positioned in a proper position according to the wearer torso length in a manner that shifts much of the weight of the burden to a healthier position i.e. to the waist area. If the backpack is positioned below the waist, at the buttock area, or above the waist, at the middle back area, health damage may occur to the wearer.

Some suggested solutions are known in the art. Most of them require disassembling parts of the backpack in order to uncover internal mechanisms that were implemented within the backpack that allow modifying the length of the shoulders straps.

Some of the prior art backpacks comprise an inner mechanism that includes a set of predefined bars, each bar designates a size (e.g. S, M, L, XL), wherein the wearer connects the shoulders straps to a specific bar according to the chosen size. These solutions are restricted to specific bars and do not provide solution to sub-middle sizes.

Another mechanism available in the market is based on an inner button that upon unlocking of a button, a sliding mechanism is unlocked that allows the wearer to adjust the shoulders straps height by sliding them upward and downward along the sliding mechanism manually and re-locking the button for fixing the desired height.

Both mechanisms described above, require disassembly and reassembly of different components of the backpack and as such are somewhat cumbersome and complicated to operate. In addition, as all of current solutions require disassembly of parts of the backpack when adjusting the shoulders straps, the adjustment process cannot be performed on the body of the wearer, and thus it may require several attempts until reaching the proper length.

The following Patents and Patent applications suggest some improvements in the backpack frames and carriers DE102014006194 (A1), FR2664139 (A1), CN203913832 (U), TWM477201 (U), KR20140066951 (A), KR20130009108 (A), and U.S. Pat. No. 5,503,314 (A).

The adjustment mechanism in most of them requires complicated engagement with different layers of the backpack, disassembling and reassembling of different components of the backpack. In some solutions, substantive parts of the backpack are taken apart for changing the length of the straps, and then these parts are re-assembled after performance of the change. Thus, they all require cumbersome engagement with the backpack components. In addition, the adjustment of the shoulder straps length should be performed on an empty bag and it is performed while the backpack is not being worn, thus, the length is only estimated and not fitted on the body of the wearer and sometimes it requires several attempts in order to fit the length.

Thus, there is still a need in the art for an adjustable backpack that is simple to operate and to modify, that does not required to empty the content of the bag each time that an adjustment is required, and that the adjustment process itself may be performed while the wearer is wearing the backpack so as to insure simple and perfect adjustment to the body dimensions of the wearer in a single adjusting attempt.

The present invention is aimed to provide such a backpack. The backpack of the invention is adjustable and configured to be fitted to different torso lengths so as to optimize the positioning of the backpack to the wearer dimensions in a simple and convenient manner. The fitting of the shoulders straps may be performed while the bag is filled with content and while it is worn on the wearer so as to allow simple and perfect fit to the dimensions of the wearer. The fitting may also be performed while the backpack is not positioned on the wearer according to the wearer preferences. The provided adjusting mechanism allows high sensitivity adjustment in a simple and friendly manner.

SUMMARY OF THE INVENTION

This invention is directed to a novel driving screw based adjusting mechanism for adjusting the shoulder straps length of a backpack for fitting the position of the backpack to the torso length of a wearer. The adjusting mechanism comprises: (a) a shell like element configured to be attached to the back wall of the backpack for holding a driving screw and a slider; (b) a driving screw connected to a key, said key is configured to allow rotation of the driving screw clockwise and counter clockwise; and (c) a slider configured to be attached to a shoulder straps belt of the backpack and further to be latched onto the shell like element, with the driving screw threaded within it; wherein, rotation of the driving screw clockwise and counter clockwise functionally slides the slider upward and downward along the shell like component together with the shoulder straps belt of the backpack that are attached to the slider, thereby enabling elongation/shortening of the backpack shoulder straps length.

In accordance with embodiments of the invention, the driving screw may be threaded within the slider via a dedicated hole and secured to the shell like element by at least one holder.

The key is preferably assembled onto the head of the driving screw while it is embedded within the shell like component and threaded into the slider; the key is configured to control the adjusting process of the backpack solder straps. The key, while being pulled up, functionally allows rotation of said driving screw and adjusting the length of the shoulder straps to the torso length of the wearer, and while being pushed down it allows fixation of the adjusted length of the shoulder straps.

In some embodiments, the key may produce a sound when rotating so as to provide indication about the extent of elongation/shortening performed in real time.

The adjustment of the shoulder straps length is controlled by the rotation direction (clockwise/counter clockwise) and the rotation cycles of the key. Each rotation cycle comprises at least two paces; each pace has a predefined length size, to ensure maximal adaptation of the shoulder straps length to the torso length of the wearer.

The shell like element comprises on its longitudinal axis two lateral protruding tips that serve as a rail on which the slider is latched onto; the slider comprises two complementary lateral tips configured to allow latching of the slider onto the shell like element so as to allow smooth movement of the slider together with the shoulder straps belt of the backpack attached thereto upon rotation of the driving screw.

In one another aspect of the invention, a backpack having a driving screw based adjusting mechanism for adjusting the shoulders straps length to a torso length of a wearer according to the above and below description is provided, wherein adjustment of the shoulder straps length may be performed while the backpack is full with content, to ease the process and save time and efforts that are usually required for emptying the bag and refilling it after the process is completed. The driving screw based adjusting mechanism is preferably embedded into the rear wall of the backpack in a hidden manner, such that only the key and the top part of the shell like component that is tangent to the key are visible and accessible to allow adjustment of the shoulder straps length.

Additionally, the adjustment of the shoulder straps length may be performed while the backpack is positioned on the back of a wearer to ensure maximal adaptation of the backpack position to the torso length of the wearer.

BRIEF DESCRIPTION OF THE DRAWINGS

Examples illustrative of embodiments of the disclosure are described below with reference to figures attached hereto. In the figures, identical structures, elements or parts that appear in more than one figure are generally labeled with the same numeral in all the figures in which they appear. Dimensions of components and features shown in the figures are generally chosen for convenience and clarity of presentation and are not necessarily shown to scale. Many of the figures presented are in the form of schematic illustrations and, as such, certain elements may be drawn greatly simplified or not-to-scale, for illustrative clarity. The figures are not intended to be production drawings.

The figures (Figs.) are listed below.

FIGS. 2A to 2E are schematic illustrations of the adjusting mechanism of FIG. 1 demonstrating the assembly sequence of the different components of the adjusting mechanism.

FIGS. 6A-C are partial close up views illustration of the components that are aimed to allow rotation of the driving screw of adjusting mechanism 100 in order to elongate or shorten the shoulders straps length of the backpack; wherein FIG. 6A illustrates the upper portion of the driving screw; FIG. 6B illustrates the bottom side of the key that is structurally suitable to be mounted on top of the driving screw; and FIG. 6C illustrates the secure of the key via a pin through a dedicated hole in the shell like element of the adjusting mechanism.

FIGS. 7A-7E are schematic illustrations that demonstrate the connection of slider 70 while it is connected to a shoulder straps belt 240 with shell like element 60 that is attached to the rear wall of the backpack, wherein, FIG. 7A is a front view illustration of the shoulder straps belt 240 attached to slider 70 and the back wall 206 of the backpack attached to shell like structure 60; FIG. 7B illustrates the back wall 206 of the backpack from top and the shoulder straps belt 240 in a bended position with slider 70 ready to be latched onto shell like element 60; FIGS. 7C and 7D are close up views on the connection area of protruding tips 61 of shell like element 60 and rounded tips 71 of slider 70 before and after their attachment respectively; FIG. 7E is a schematic illustration of adjusting mechanism 100 connected to the inner side of the rear wall 206 of a backpack and to the shoulder straps belt 240 in a ready to use form.

DESCRIPTION OF VARIATIONS OF THE INVENTION

Figure 1:
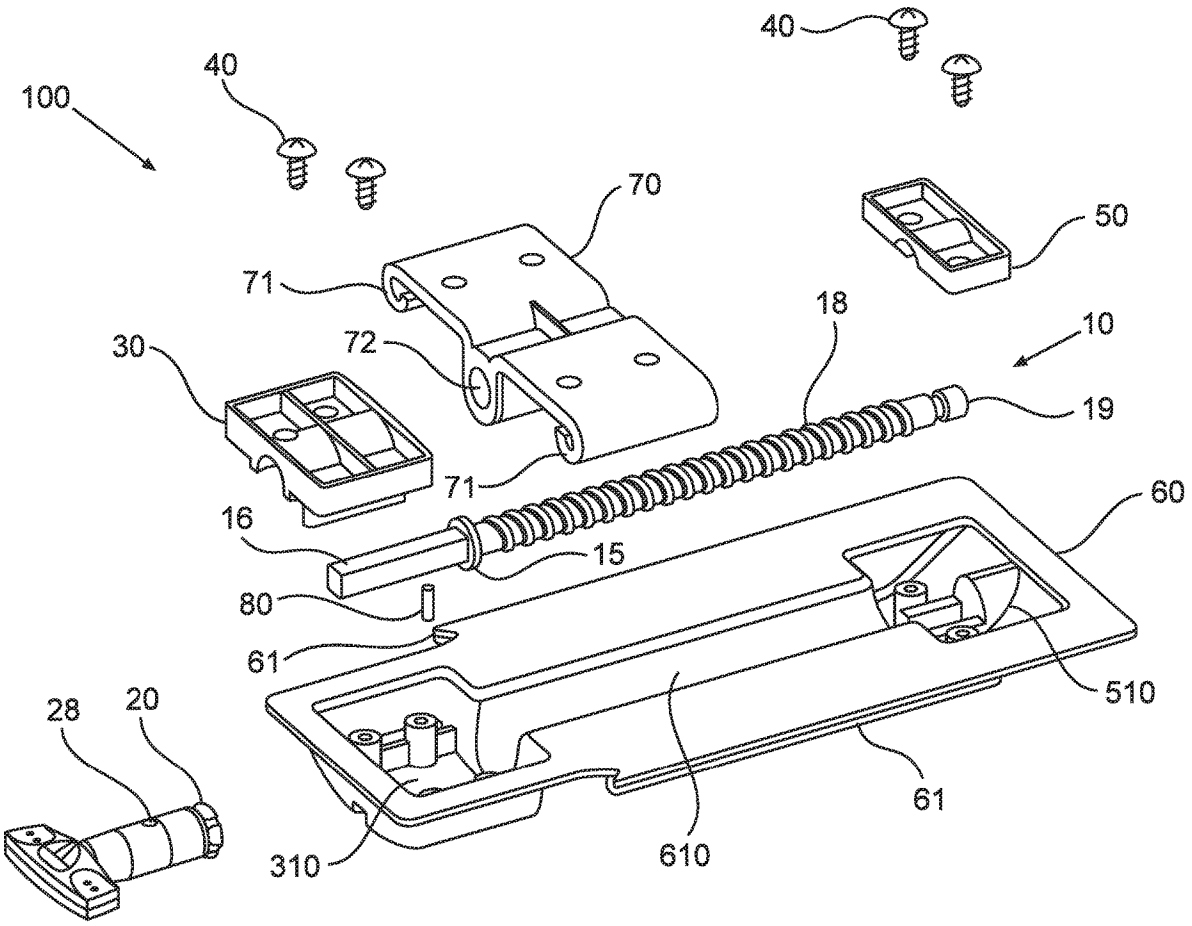
FIG. 1 is a schematic exploded view illustration of a driving screw based shoulder straps length adjusting mechanism (hereinafter: "adjusting mechanism") configured and operable to allow adjustment of the shoulder straps length of a backpack according to the torso length of a wearer.

Various aspects of a novel backpack having a driving screw based adjusting mechanism for adjusting the shoulder straps length to fit with the torso length of a specific wearer will be described hereinbelow. For the purpose of explanation, specific configurations and details are set forth in order to provide a thorough understanding of the invention.

Although various features of the disclosure may be described in the context of a single embodiment, the features may also be provided separately or in any suitable combination. Conversely, although the disclosure may be described herein in the context of separate embodiments for clarity, the disclosure may also be implemented in a single embodiment. Furthermore, it should be understood that the disclosure can be carried out or practiced in various ways, and that the disclosure can be implemented in embodiments other than the exemplary ones described herein below. The descriptions, examples and materials presented in the description, as well as in the claims, should not be construed as limiting, but rather as illustrative.

Terms for indicating relative direction or location, such as "right" and "left", "up" and "down", "rear", "back" and "front", "top" and "bottom", "horizontal" and "vertical", "higher" and "lower", and the like, may also be used, without limitation.

In accordance with one aspect of the present invention an adjustable backpack having a shoulder straps length adjusting mechanism based on a driving screw is provided. The adjusting mechanism functionally allows to change the shoulders straps length i.e. to elongate the straps length or shorten them in order to fit the straps length to the wearer torso length, in order to enable healthier positioning of the backpack on the wearer back and avoid damage that may occur to the wearer, when carrying the backpack in an unfitted position of the backpack due to the load created by carrying the backpack, especially when it has heavy weight.

When referring to children the need to position a school bag properly in order to avoid health damages to the child along with the ability to fit the bag to the torso length of the child as he/she grows is crucial.

The novel adjustable backpack of the invention allows simple and convenient fitting of the positioning of the backpack to the torso length of the wearer thanks to a novel driving screw based adjusting mechanism that simply allows adjustment of the shoulder straps length by rotation of a driving screw connected to the shoulders straps and also connected to the back wall of the backpack, either clockwise or counterclockwise, according to the desired outcome, wherein, the elongation of the shoulder straps length or shortening their length may be performed either when the backpack is empty or when it is filled with content. The adjustment may be performed while the backpack is positioned on the wearer's back to ensure maximal fitting. Alternatively, the wearer may fit the length of the straps when he/she are not wearing the backpack, according to his/her convenient. When the adjustment is performed while the backpack is being worn, the wearer can use another person's assistance to perform the adjustment, especially when it comes to children, as it will be described in details below.

The structure and function of the novel backpack will be better demonstrated with reference to the description of the exemplifying figures below.

FIG. 1 is a schematic exploded view illustration of a driving screw based adjusting mechanism 100 (hereinafter: "Adjusting mechanism") configured and operable to be assembled within a backpack to allow adjustment of the shoulder straps of the backpack according to the torso length of a specific wearer. In the example illustrated in this figure, the adjusting mechanism comprises a shell like element 60. Shell like element 60 is configured to be attached to the back wall of a backpack. The back side of shell like element 60 is positioned in the back side of the backpack (shown in FIG. 5), while the front side of shell like element 60 is facing the inner space of the backpack. Shell like element 60 contains notches and grooves fitting to insertion and assembly of other components as will be described hereinbelow. Both longitudinal sides of shell like element 60 have protruding tips 61 that functionally serve as a rail, on which a slider 70 is latched onto by rounded tips 71 and slides upward and downward along a driving screw 10. Slider 70 if configured to be attached to a shoulder straps belt and further comprises a hole 72 through which, the driving screw 10 is inserted in order to link between the rotation of the driving screw to the movement of the slider upward and downward along shell like element 60. The term "shoulder straps belt" as used herein is used to describe the two shoulder straps and the connecting area of the two straps that is usually hidden within the back wall of the backpack. The term "shoulder straps" as used herein is used to describe the two shoulder straps without the connection area of the straps, i.e. the visible part of the shoulder straps belt.

Since slider 70 is configured to be attached to the shoulders straps belt, its movement also moves the shoulder straps belt upward and downward and results in extension/shortening of the available length of the shoulder straps.

Shell like element 60 further comprise a canal like structure 610 for positioning driving screw 10 within it, and two dedicated sockets 310 and 510 for positioning and securing a top holder 30 and a bottom holder 50 respectively, with screws 40 to shell like element 60. Slider 70 is physically connected to the shoulders straps (shown in FIG. 7) and according to its movement along driving screw 10, a corresponding elongation/shortening of the shoulder straps occurs, as they move upward (elongated form of the straps) and downward (shortened form of the straps) together with slider 70. The movement of slider 70 along shell like element 60 is performed by the rotation of driving screw 10. Driving screw 10 generally comprises 3 main areas: a top area 16 on which a key 20 is mounted, a spiral area separated from the top area by shelf 15, and a bottom area 19. Driving screw 10 is assembled between shell like element 60 and slider 70 and secured to shell like element 60 by top holder 30 and bottom holder 50; both holders are inserted into dedicated sockets 310 and 510 respectively, and attached to shell like element 60 by screws 40. It should be clear that other forms and means to secure driving screw 10 to shell like element 60 should also be considered as being within the scope of the invention and the two covers described in the above with reference to FIG. 1 are only a non-limiting example.

The rotation of driving screw 10 is functionally performed by rotating a key 20 that is mounted on the top portion 16 of driving screw 10 and fixed to shell like element 60 by a pin 80. Top portion 16 has a square shape that is compatible to an inner squire hole inside key 20 (shown in details in FIGS. 6A-6C). This structure causes the driving screw 10 to rotate upon rotation of key 20. Pin 80 is inserted into dedicated holes 28, 28' in shell like element 60 and key 20 and moves upward and downward between two bulges as described in details with reference to FIG. 6A hereinbelow.

FIGS. 2A to 2E are schematic illustrations of the driving screw based adjusting mechanism 100 of FIG. 1, demonstrating the constructing sequence of the various components of adjusting mechanism 100, to teach about the relative positioning of each component relative to the other components of the mechanism. For simplicity of explanation adjusting mechanism 100 is illustrated in these figures without the backpack components (the shoulder straps and the rear wall of the backpack) that it is configured to be connected to for operating.

FIG. 2A schematically illustrates the components of system 100 separated one from the other and is similar to FIG. 1, while FIG. 2E illustrates the components of adjusting mechanism 100 fully assembled. Shown in these figures are shell 60 with protruding edges 61, driving screw 10, key 20, pin 80, top holder cover 30 and bottom holder cover 50, slider 70 with rounded tips 71, and screws 40. FIGS. 2B, 2C, and 2D illustrate different stages during the construction process of adjusting mechanism 100. In FIG. 2B driving screw 10 is positioned within a dedicated canal like structure 610 within shell like element 60; key 20 is mounted on top of driving screw 10 (FIG. 2C); afterward, top holder 30 and bottom holder 50 are inserted into dedicated sockets 310 and 510 of shell like element 60 and attached thereto by screws 40; slider 70 is latched onto shell like element 60 by insertion of protruding tips 61 into rounded tips 71. It should be clear that in accordance with embodiments of the invention rounded tips 71 and protruding tips 61 may be shaped in any desired shape as long as they fit one to the other in a manner that protruding tips 61 functionally serve as a rail to slider 70, that functionally operates as a locomotive that drives the shoulder straps belt of the backpack upward and downward in order to elongate or shorten the shoulder straps length.

Figure 3C:
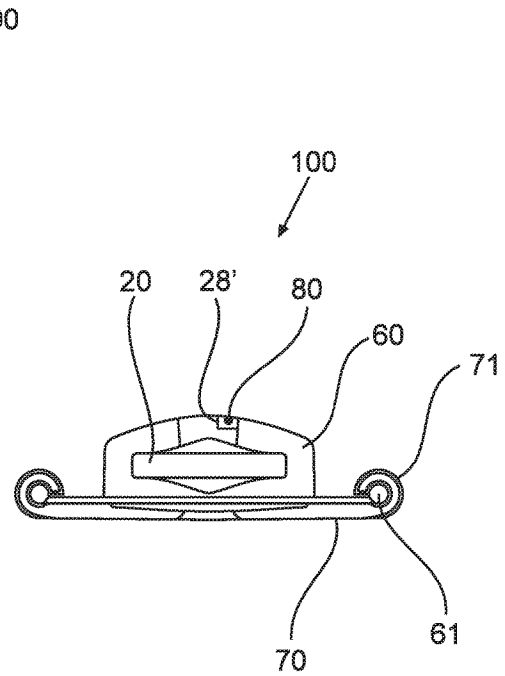
FIGS. 3A to 3C are front view, side view and top view illustrations respectively, of the adjusting mechanism of FIG. 1.
Figure 3B:
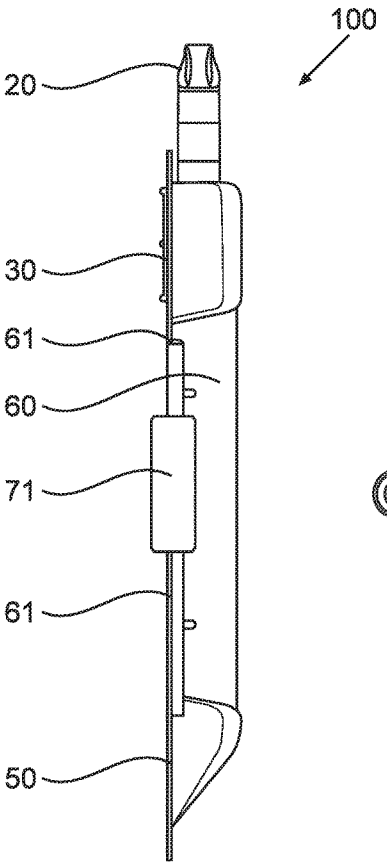
Figure 3A:
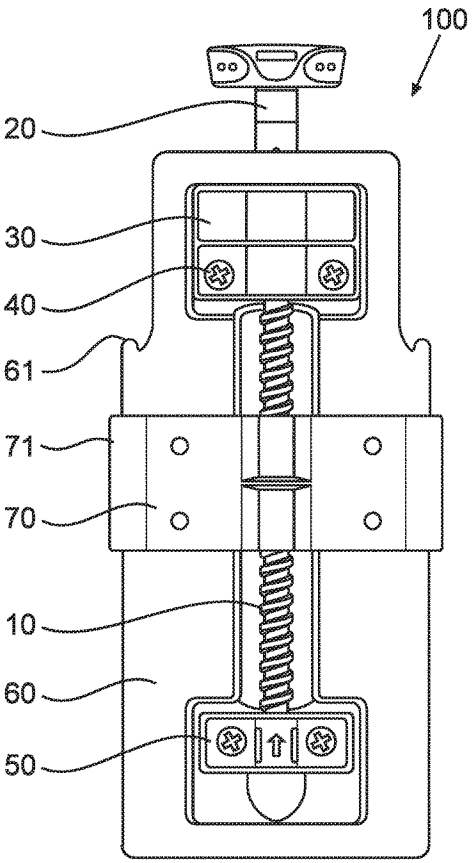

FIGS. 3A to 3C are front view, side view and top view illustrations respectively, of the adjusting mechanism 100 of FIGS. 1 and 2 when all the components of the mechanism are assembled together ready to operate. As shown in these figures the unique structure of adjusting mechanism 100 allows its functionality in a simple and friendly manner to the user. The movement of slider 70 upward (to elongate the shoulder straps length) and downward (to shorten the shoulder straps length) along driving screw 10 is simply obtained by rotating key 20 clockwise and counter clockwise in a highly controllable and accurate manner. The movement of slider 70 along driving screw 10 is further supported by the smooth sliding of rounded tips 71 onto protruding tips 61. The complimentary structure of protruding tips 61 of shell like element 60 and the rounded tips 71 of slider 70 is well shown from the top view (FIG. 3C) and from the side (FIG. 3B). Also shown in there figures are shell like element 60, rails of shell (protruding tip) 61, slider 70, slider rounded tips 71, driving screw 10, key 20, pin 80, hole 28', top holder 30, bottom holder 50, and screws 40. Upon attachment of adjusting mechanism 100 to a backpack (illustrated in details in FIGS. 7A-7F), slider 70 is attached to the shoulders straps and "drives" the straps upward and downward according to its position along the driving screw 10, while the rest of mechanism 100 is attached to the back wall of the bag and remains in a static position.

Figure 4:
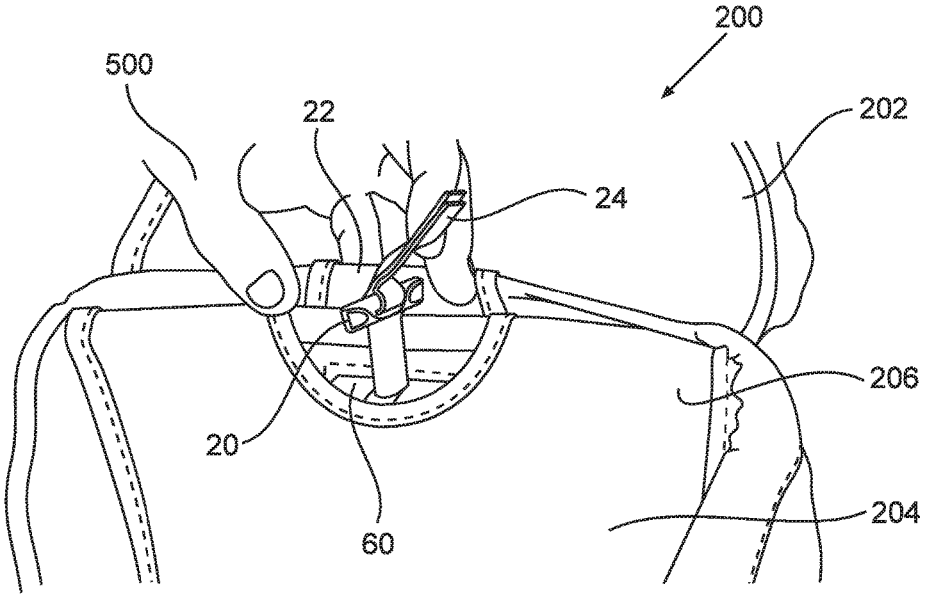
FIG. 4 is a partial isometric view of one example of a backpack having the adjusting mechanism of FIG. 1 for adjusting the length of the shoulder straps of the backpack.

FIG. 4 is a partial front-top view illustration of an example of a backpack 200 comprising adjusting mechanism 100 for changing the length of the shoulder straps so as to fit it to the torso length of a wearer and to properly position the backpack without causing health problems to the wearer. In this view, backpack 200 is open and the top portion of the inner part of the backpack is shown. Mechanism 100 is integrated to the back wall of backpack 200 and most of it is covered with fabric. The only parts that are visible to the wearer are the upper part of shell like element 60 and key 20. When the adjusting mechanism 100 is not in use, key 20 is being pressed downward toward the top area of shell like element 60. At this position, the top area of shell 60 like element as well as the back wall of the backpack are mechanically blocking key 20 and it cannot rotate. This state is the "none functional state" of adjusting mechanism 100. In this state, it may also be covered with a dedicated cover 22 for aesthetic reasons to hidden the mechanism. When the length of the shoulder straps should be adjusted, key 20 should first be pulled up to a position where the key is above the back wall of the backpack in order to provide 20 the required space for rotation as its rotation further rotate driving screw 10 that slides the slider together with the shoulder straps belt. When the wearer needs to elongate/shorten the straps length, he/she uncover key 20 below cover 22, pulls upward the key and start to rotate it clockwise or counterclockwise according to the desired outcome (shortening or elongating the straps). Optionally, key 20 may be connected to a pulling strap 24 so as to provide the wearer a convenient approach to the key and easily pull it upward. In some further embodiment the shoulder straps comprise dedicated marks that provide the user indication about the extended/shortened length as shown in FIG. 7E.

In further embodiments of the invention, rotation of the key may be accompanied by a sound to further provide the user an audio indication that the shoulder straps are being elongated or being shortened and according to the duration of the sound to give the wearer a notion about the extension/shortening amount. The sound for example may be clicks sound that are being produced during rotation of the key. In such embodiment, the backpack user's manual may include the scale between the number of clicks and length change. For example, five (5) clicks may indicate an extension/reduction of 0.5 cm, and if the user needs an extension of about 2.0 cm, he/she knows that they should count 20 clicks in order to obtain the desired length of straps.

When the wearer or a person assisting the wearer to adjust the shoulder straps length (for example when the wearer is a child) reaches the fitted size he/she should press downward key 20 toward shell like element 60 and cover it with cover 22. By pushing the key downward, any further rotation of the key and consequently of the driving screw is not enabled as the back wall 206 of backpack 200 blocks it. Also shown in this figure are inner space 204 of backpack 200, inner side of back wall 206 of the backpack, upper cover 202 of backpack and a hand of wearer 500 (or of any other person that assists the wearer to adjust the shoulder straps length).

Figure 5:
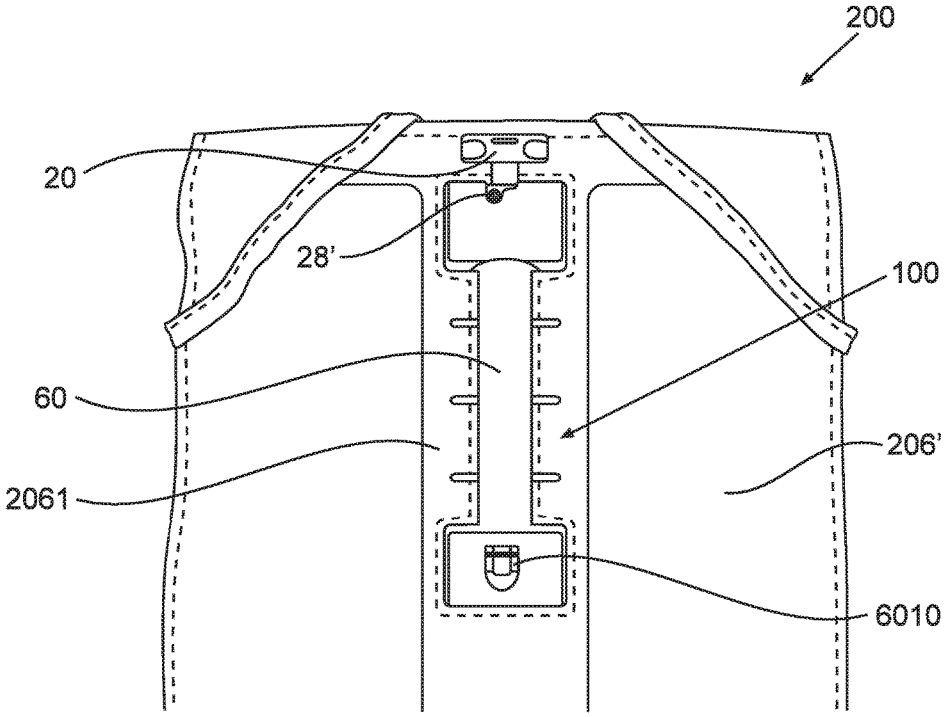
FIG. 5 is a partial view of the backpack of FIG. 4 showing the integration of adjusting mechanism 100 of FIG. 1 within the back wall of a backpack (uncovered) showing the rear side of the adjustment mechanism.

FIG. 5 is a partial view of backpack 200 of FIG. 4 showing the integration of the adjusting mechanism 100 within the back (outer) side 206' of back wall 206 of the backpack (uncovered, without covering fabric) showing the back side of shell like element 60 and key 20 of adjusting mechanism 100. In the none-limiting example shown in this view, the back side of shell like element 60 is shown stitched to fabric 2061 that is part of the back wall 206' of backpack 200. Key 20 is protruding above shell like element 60 in a parallel position to the backpack back wall in a pushed down form (non-rotatable position). In this view the shoulder straps are not shown in order to provide clear view of the rear wall of the backpack.

Figure 6A:
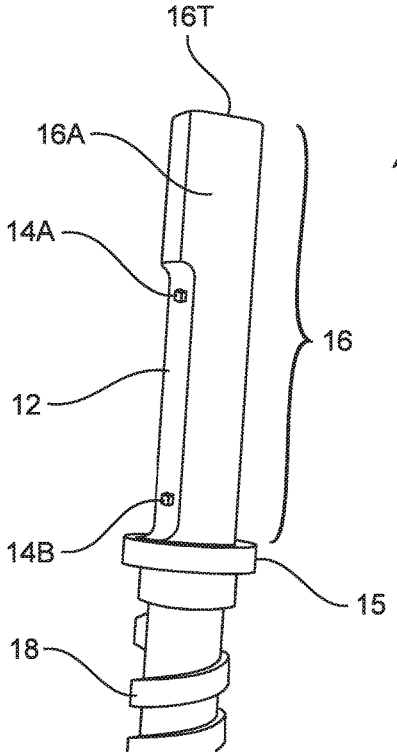
Figure 6B:
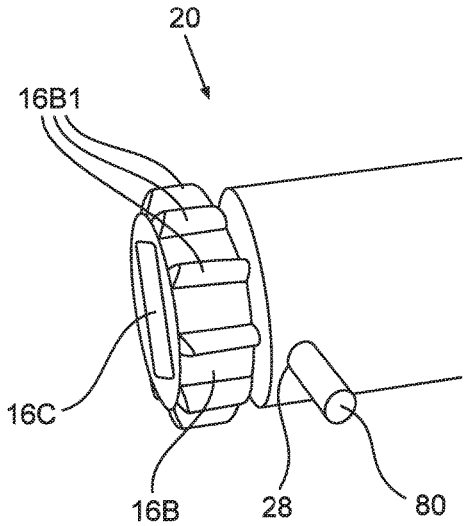
Figure 6C:
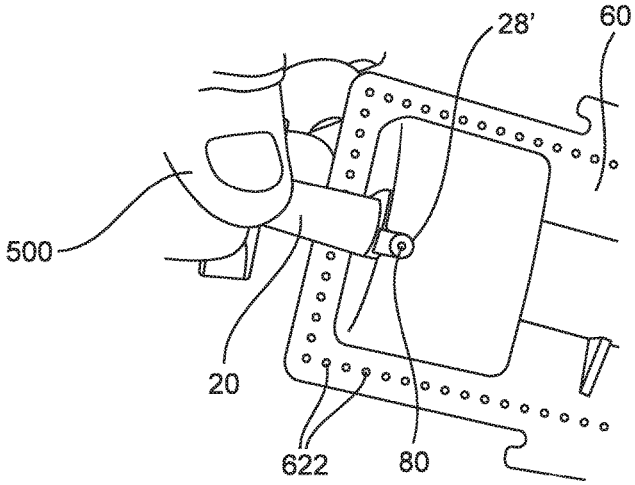

FIGS. 6A-C are close up views of the connection area of the upper part of driving screw 10 (FIG. 6A) and the bottom part of key 20 (FIG. 6B), and the connection of both to shell like element 60 (FIG. 6C) of adjusting mechanism 100 illustrated in FIG. 1. These components and the connection between them functionally allow the rotation of driving screw 10 in order to elongate or shorten the shoulder straps length of the backpack.

As mentioned above, the rotation of driving screw 10 is operated by key 20 that is being mounted on top of driving screw 10 and secured to adjusting mechanism 100 by a pin 80 that is being inserted through a dedicated hole 28 in key 20 and through a dedicated opening 28' in shell like element 60 of adjusting mechanism 100. Key 20 allows the wearer 500 (or a person assisting the wearer) to rotate the driving screw in order to elongate or to shorten the shoulder straps available length by changing the position of the shoulder straps belt along the back wall of the backpack in a manner that when the shoulder straps belt is positioned at the bottom area of the driving screw the available shoulder straps length is shortened and minimized, and when the shoulder straps belt is positioned at the upper area of the driving screw, the available shoulder straps length is extended and maximized. Any positioning in-between them is possible by the provided mechanism that allows optimal positioning of the backpack according to the wearer body dimensions (i.e. the torso length). Changing the positioning of the shoulder straps belt along the driving screw (i.e. along the back wall of the backpack) is enabled by simple rotation of key 20 clockwise or counterclockwise according to the desired outcome i.e. extension of the available length of the shoulder straps for a user with relatively long torso length or shortening of the available length of the shoulder straps for a user with relatively short torso length, to fit the positioning of the backpack to the specific dimensions of the wearer and prevent future health problems that may occur.

FIG. 6A is a close up view of the upper section 16A of driving screw 10 that is designed in this specific example as a square having a side groove 12 having an upper bulge 14A and a lower bulge 14B for limiting the movability of key 20 by limiting the movement of pin 80 when inserted through hole 28 along notch 12 (pin and hole are shown in FIG. 6B). The distance between the two bulges is suitable to the distance required to pull up key 20 above the back wall of the backpack to provide it the required space for rotating. When the adjustment process of the shoulder straps length begins, key 20 is pulled upward, pin 80 is positioned above upper bulge 14A for limiting the movement of key 20 downward, and when key 20 is pushed downward after the adjustment of the length is made, pin 80 is positioned below the lower bulge 14B for limiting the movement of key 20 upward. In the specific example illustrated in these figures, the top surface 16T of driving screw 10 is shaped as a square surface configured to fit to the inner opening 16C of the bottom portion of key 20. This compatible square structure enables the rotation of the driving screw upon rotation of the key. It should be clear that the structure of top surface 16T and of inner opening 16C may vary, as long as both have a complementary structure. Also shown in FIG. 6A are: shelf 15 that mechanically separates between the upper area 16A of driving screw 10 to the spiral area 18 of driving screw 10.

FIG. 6B is a close up view of the bottom area 16B of key 20 with opening 16C that is structurally shaped in a complementary manner to the upper section of driving screw 10 to thereby allow key 20 to be mounted on top of the upper section 16A of driving screw 10. Bottom area 16B may contain (optional) plurality of mini tiles 16B1 that upon rotation are rubbing against internal plastic tongue (not shown) that is a part of shell like element 60 and positioned adjacent to hole 28. Upon rotation of the key, these mini tiles produce a sound (e.g. a click) that provides indication about the rotation amount. As mentioned above, in some embodiments of the invention the ratio between the number of clicks and the change in length units may be pre-determined, such that the wearer or a person assisting the wearer knows in advance, for example, that 10 clicks are equal to 1.0 cm. Also shown in this figure is hole 28 suitable for insertion of pin 80 in order to secure the key and ensure that it will not detach from the rest of adjusting mechanism 100 during rotation, and further to secure it to the adjusting mechanism while pulling key 20 upward to an unlocked, ready for rotation position.

FIG. 6C is a schematic illustration of key 20 secured to shell like element 60 and to driving screw 10 (not shown) by pin 80 being inserted through hole 28 of key 20 and through opening 28' in shell like element 60. Also shown in this figure are: hand 500 holding key 20 in a position ready to pull it upward for rotation, and holes 622 (optional) for stitching shell like element 60 to a fabric that covers the back wall of the backpack. Attachment of shell like element 60 may be performed by other means as well. The positioning of the adjusting mechanism within the backpack is fully described with reference to FIGS. 7A to 7E hereinbelow.

Figure 7A:
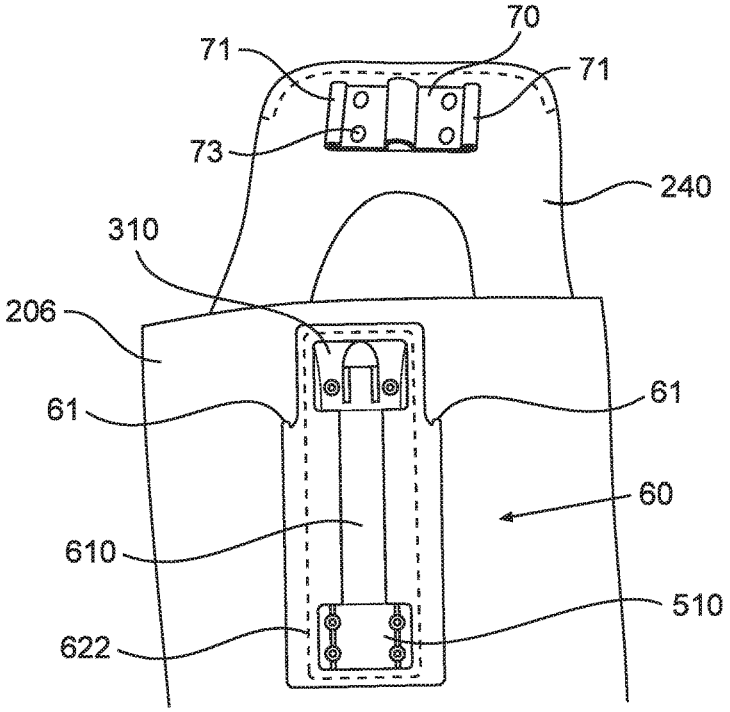
Figure 7B:
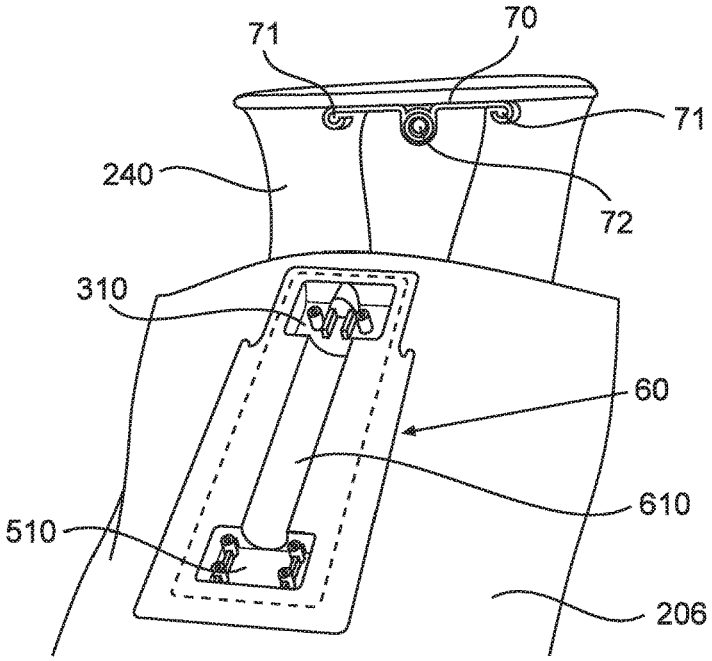
Figure 7C:
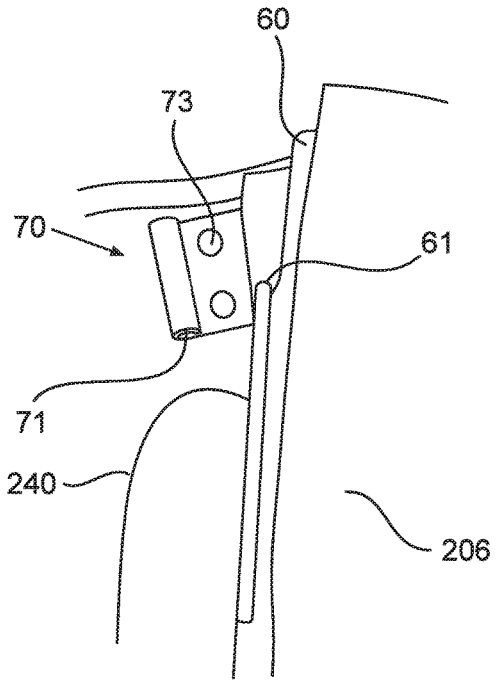
Figure 7D:
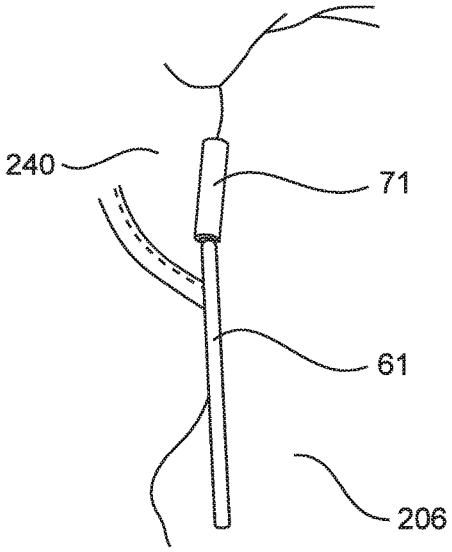
Figure 7E:
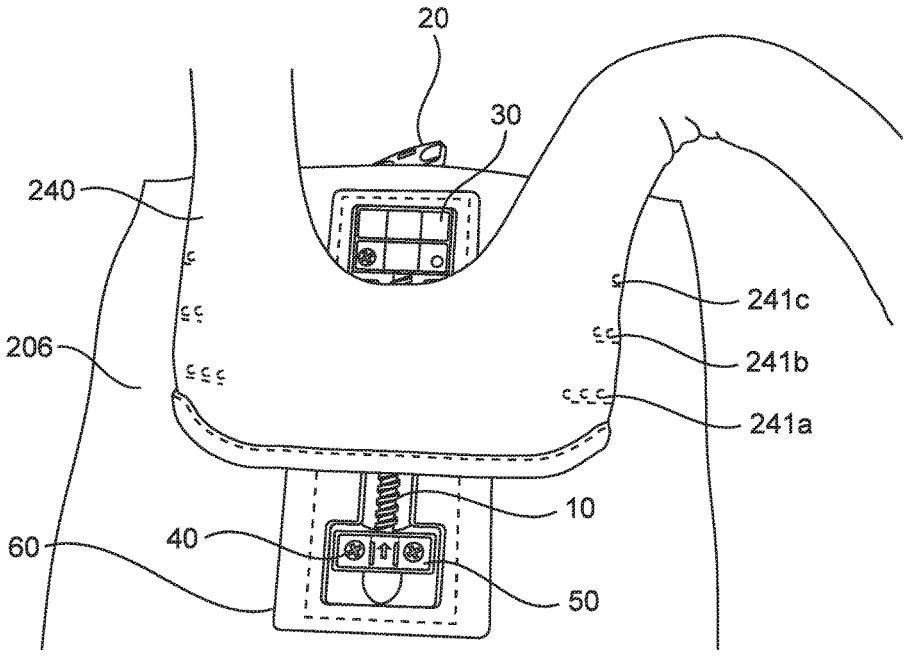

FIGS. 7A-7E are schematic illustrations that demonstrate the attachment of slider 70 while it is connected to a shoulder straps belt 240, to shell like element 60 that is connected to the back wall of the backpack, wherein FIG. 7A is a partial top view illustration of the shoulder straps belt 240 attached to slider 70 and the back wall 206 of the backpack attached to shell like structure 60 when both are placed flat on a surface (surface not shown); FIG. 7B illustrates the back wall 206 of the backpack from top and the shoulder straps belt 240 in a bended position with slider 70 ready to be latched onto shell like element 60; FIGS. 7C and 7D are close up views on the connection area of protruding tips 61 of shell like element 60 and rounded tips 71 of slider 70 before and after latching respectively; FIG. 7E is a schematic illustration of adjusting mechanism 100 connected to the inner side of the back wall 206 of the backpack and to the shoulder straps belt 240.

In more details, FIGS. 7A and 7B schematically illustrate shoulder straps belt 240 attached to slider 70 before it is assembled with the back wall 206 of the backpack via shell like element 60. The assembly between them is achieved by latching the rounded tips 71 of slider 70 onto protruding tips 61 of shell like element 60 that serve as a rail for slider 70. FIG. 7B illustrates shoulder straps belt 240 when bended toward shell like element 60 to show the complementary structure of the slider and the shell like element 60 that allows smooth movement of the shoulder straps belt during elongation or shortening of the shoulder straps. For simplicity of explanation, other components of adjusting mechanism 100 are not shown (driving screw and holders). Also shown in these figures are connecting studs that connect slider 70 to the shoulder straps belt 240, stitches 622 that connect shell like element 60 to back wall 206 of the backpack, and areas 310, 610 and 510 of shell like element 60.

FIGS. 7C and 7D are close up side views on the connection area of protruding tips 61 of shell like element 60 and rounded tips 71 of slider 70 before and after latching them one onto the other, respectively. Each one of tips 71 of slider 70 (female piping) is being mounted on the parallel protruding tip 61 (male piping) of shell like element 60 that serves as a rail for slider 70. Also shown in these views are back wall 206 of the backpack, shoulder straps belt 240 and studs 73 (only in 7C).

FIG. 7E is a schematic illustration of adjusting mechanism 100 connected to the inner side of the back wall 206 of a backpack and to the shoulder straps belt 240 attached to slider 70 (the slider is hidden by the shoulder straps belt). In this figure, all components of adjusting mechanism 100 as described in details with reference to FIGS. 1-6 are shown. In accordance with embodiments of the invention, the shoulder straps belt 240 may comprise scale marks on it, such as but not limited to the marks 241*a*, 241*b* and 241*c* to indicate the length change of the shoulder straps. Also shown in this figure are: shell like element 60, top holder 30, bottom holder 50, driving screw 10, screws 40, and key 20.

It should be clear that the description of the embodiments and attached Figures set forth in this specification serves only for a better understanding of the invention, without limiting its scope. It should also be clear that a person skilled in the art, after reading the present specification could make adjustments or amendments to the attached Figures and above described embodiments that would still be covered by the present invention.

The invention claimed is:

1. A driving screw based adjusting mechanism for adjusting the shoulder straps length of a backpack for fitting the position of the backpack to the torso length of a wearer, said adjusting mechanism comprising:

a. a shell like element configured to be attached to the back wall of the backpack for holding a driving screw and a slider;

b. a driving screw connected to a key, said key is configured to allow rotation of the driving screw clockwise and counter clockwise; and c. a slider configured to be attached to a shoulder straps belt of the backpack and further to be latched onto the shell like element, with the driving screw threaded within it;

wherein, rotation of the driving screw clockwise and counter clockwise functionally slides the slider upward and downward along the shell like component together with the shoulder straps belt of the backpack that are attached to the slider, thereby enabling elongation/shortening of the backpack shoulder straps length.

2. The adjusting mechanism according to claim 1, wherein said driving screw is being threaded within the slider via a dedicated hole and secured to the shell like element by at least one holder.

3. The adjusting mechanism according to claim 1, wherein the key is assembled onto the head of the driving screw while it is embedded within the shell like component and threaded into the slider; said key is configured to control the adjusting process of the backpack shoulder straps.

4. The adjusting mechanism according to claim 1, wherein said key while being pulled up allows rotation of said driving screw and adjusting the length of the shoulder straps to the torso length of the wearer, and while being pushed down it allows fixation of the adjusted length of the shoulder straps.

5. The adjusting mechanism according to claim 1, wherein said key produces a sound when rotating so as to provide indication about the extent of elongation/shortening performed in real time.

6. The adjusting mechanism according to claim 1, wherein the adjustment of the shoulder straps length is controlled by the rotation direction (clockwise/counter clockwise) and the rotation cycles of the key.

7. The adjusting mechanism according to claim 6, wherein each rotation cycle comprises at least two paces, each pace has a predefined length size, to ensure maximal adaptation of the shoulder straps length to the torso length of the wearer.

8. The adjusting mechanism according to claim 1, wherein the shell like element comprises on its longitudinal axis two lateral protruding tips that serve as a rail on which the slider is latched onto; said slider comprises two complementary lateral tips configured to allow latching of the slider onto the shell like element so as to allow smooth movement of the slider together with the shoulder straps belt of the backpack attached thereto upon rotation of the driving screw.

9. A backpack having a driving screw based adjusting mechanism for adjusting the shoulder straps length of a backpack for fitting the position of the backpack to the torso length of a wearer, said adjusting mechanism comprises:

a. a shell like element configured to be attached to the back wall of the backpack for holding a driving screw and a slider;

b. a driving screw connected to a key, said key is configured to allow rotation of the driving screw clockwise and counter clockwise; and c. a slider configured to be attached to a shoulder straps belt of the backpack and further to be latched onto the shell like element, with the driving screw threaded within it;

wherein, rotation of the driving screw clockwise and counter clockwise functionally slides the slider upward and downward along the shell like component together with the shoulder straps belt of the backpack that are attached to the slider, thereby enabling elongation/shortening of the backpack shoulder straps length.

10. The backpack according to claim 9, wherein said driving screw based adjusting mechanism is embedded into the rear wall of the backpack in a hidden manner, such that only the key and the top part of the shell like component that is tangent to the key are visible and accessible to allow adjustment of the shoulder straps length.

11. The backpack according to claim 9, wherein adjustment of the shoulder straps length may be performed while the backpack is positioned on the back of a wearer to ensure maximal adaptation of the backpack position to the torso length of the wearer.

12. The backpack according to claim 9 wherein adjustment of the shoulder straps length may be performed while the backpack is full with content.

13. A driving screw based adjusting mechanism for adjusting the shoulder straps length of a backpack for fitting the position of the backpack to the torso length of a wearer, said adjusting mechanism comprising:

a. a shell like element configured to be attached to the back wall of the backpack for holding a driving screw and a slider;

b. a driving screw connected to a key, said key is configured to allow rotation of the driving screw clockwise and counter clockwise; and c. a slider configured to be attached to a shoulder straps belt of the backpack and further to be latched onto the shell like element, with the driving screw threaded within it;

wherein, rotation of the driving screw clockwise and counter clockwise functionally slides the slider upward and downward along the shell like component together with the shoulder straps belt of the backpack that are attached to the slider, thereby enabling elongation/shortening of the backpack shoulder straps length; and wherein said key while being pulled up allows rotation of said driving screw and adjusting the length of the shoulder straps to the torso length of the wearer, and while being pushed down it allows fixation of the adjusted length of the shoulder straps.

14. The adjusting mechanism according to claim 13, wherein said driving screw is being threaded within the slider via a dedicated hole and secured to the shell like element by at least one holder.

15. The adjusting mechanism according to claim 13, wherein the key is assembled onto the head of the driving screw while it is embedded within the shell like component and threaded into the slider; said key is configured to control the adjusting process of the backpack shoulder straps.

16. The adjusting mechanism according to claim 13, wherein said key produces a sound when rotating so as to provide indication about the extent of elongation/shortening performed in real time.

17. The adjusting mechanism according to claim 13, wherein the adjustment of the shoulder straps length is controlled by the rotation direction (clockwise/counter clockwise) and the rotation cycles of the key.

18. The adjusting mechanism according to claim 17, wherein each rotation cycle comprises at least two paces, each pace has a predefined length size, to ensure maximal adaptation of the shoulder straps length to the torso length of the wearer.

19. The adjusting mechanism according to claim 13, wherein the shell like element comprises on its longitudinal axis two lateral protruding tips that serve as a rail on which the slider is latched onto; said slider comprises two complementary lateral tips configured to allow latching of the slider onto the shell like element so as to allow smooth movement of the slider together with the shoulder straps belt of the backpack attached thereto upon rotation of the driving screw.

* * * * *